US006742991B2

(12) United States Patent
Soechting et al.

(10) Patent No.: US 6,742,991 B2
(45) Date of Patent: Jun. 1, 2004

(54) TURBINE BLADE AND GAS TURBINE

(75) Inventors: Friedrich Soechting, Miami, FL (US); Satoshi Hada, Takasago (JP); Masamitsu Kuwabara, Takasago (JP); Junichiro Masada, Takasago (JP); Yasuoki Tomita, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/192,676

(22) Filed: Jul. 11, 2002

(65) Prior Publication Data

US 2004/0009066 A1 Jan. 15, 2004

(51) Int. Cl.[7] ..... F01D 5/18
(52) U.S. Cl. ..... 416/97 R; 416/96 A
(58) Field of Search ..... 415/115; 416/97 R, 416/96 A

(56) References Cited

U.S. PATENT DOCUMENTS 4,252,501 A * 2/1981 Peill ..... 415/115
4,297,077 A * 10/1981 Durgin et al. ..... 416/97 R
5,120,192 A * 6/1992 Ohtomo et al. ..... 415/115
5,533,864 A * 7/1996 Nomoto et al. ..... 416/96 A

FOREIGN PATENT DOCUMENTS

JP 9-507550 7/1997

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A turbine blade applicable to a gas turbine has a turbine blade body having film cooling holes, the interior space of which is partitioned into two cavities by a rib. Hollow inserts each having impingement holes are respectively arranged in the cavities to form cooling spaces therebetween. Communication is ensured between the cavities by bypass hole and slits, so that the impingement cooling is interrupted with respect to the prescribed side having a good heat transmission in the turbine blade body. A partition wall is further arranged between the rib and the insert arranged in the trailing-edge side, thus providing a separation between the cooling spaces respectively arranged in the rear side and front side. Thus, it is possible to noticeably reduce the amount of cooling air in the turbine blade body; and it is possible to reduce temperature differences entirely over the turbine blade body as small as possible.

12 Claims, 5 Drawing Sheets

TURBINE BLADE AND GAS TURBINE

BACKGROUND OF THE INVENTION

1. Field of the Invention

This invention relates to gas turbines, and in particular relates to turbine blades such as moving blades and stationary blades equipped in gas turbines.

2. Description of the Related Art

FIG. 4 shows a cross section of an approximately center portion of a stationary blade of a second row (row 2) (hereinafter, referred to as a turbine blade) equipped in a turbine unit (not shown) along with the plane substantially perpendicular to an axial line in a vertical or upright direction.

That is, a typical example of a turbine blade 10 shown in FIG. 4 comprises a turbine blade body 20 and inserts 30.

In the plane substantially perpendicular to an axial line of the turbine blade body 20 in the vertical direction, a leading edge 'L.E.' is connected with a trailing edge 'T.E.' by a 'curved' center line 'C.L.'. A sheet of a plate-like rib 22 is arranged substantially perpendicular to the center line C.L. and partitions the interior space of the turbine blade 20 into two cavities C1 and C2. Air holes 24 having pin fins 23 are arranged with respect to the cavity C2 that is arranged in the side of the trailing edge T.E., wherein they force the cooling air in the cavity C2 to flow towards the exterior of the turbine blade body 20.

The insert 30 has a hollow shape and provides the prescribed number of impingement cooling holes 31. One insert 30 is inserted into each of the cavities C1 and C2 in such a way that a cooling space C.S. is formed between an exterior surface 32 of the insert 30 and an interior surface 25 of the turbine blade body 20.

In the turbine blade 10 having the aforementioned structure, the cooling air is introduced into the internal spaces of the inserts 30 by a specific means (not shown); then, the cooling air is forced to flow into the cooling spaces C.S. through the impingement holes 31 as shown by solid arrows in FIG. 5, so that the turbine blade body 20 is subjected to impingement cooling. Then, the cooling air is further forced to flow outwards through plural film cooling holes 21 arranged in exterior walls of the turbine blade body 20. This causes film layers formed around exterior walls of the turbine blade body 20 due to the cooling air, so that the turbine blade body 20 is subjected to film cooling. In addition, the cooling air spurts out through the air holes 24 from the trailing edge T.E. Herein, the proximal portion of the trailing edge T.E. of the turbine blade body 20 is cooled down by the cooling air cooling the pin fins 23.

In the aforementioned turbine blade 10, however, the cooling efficiency may be deteriorated with respect to the pin fins 23 that are arranged in proximity to the trailing edge T.E. of the turbine blade body 20. This causes a problem in that in order to cool down the pin fins 23, a considerable amount of cooling air should be forced to spurt out from the impingement cooling holes 31 of the insert 30 that is arranged in the cavity C2.

Since a considerable amount of cooling air is forced to spurt out from the impingement cooling holes 31 of the insert 30 arranged in the cavity C2, the corresponding portion, that is, the center portion of the turbine blade body 20 shown in FIGS. 4 and 5 must become excessively cool compared with other portions such as the leading edge portion locating the cavity C1 and the trailing edge portion locating the pin fins 23 and air holes 24. This causes a problem in that unwanted temperature differences occur within the turbine blade body 20.

In addition, there is a problem in that when temperature differences occur within the turbine blade body 20, thermal stress must occur due to differences of thermal expansions.

SUMMARY OF THE INVENTION

It is an object of the invention to provide a turbine blade that can reduce the amount of cooling air and improve the overall performance of a gas turbine using it.

It is another object of the invention to provide a turbine blade that can reduce temperature differences within a turbine blade body to be as low as possible.

A turbine blade applicable to a gas turbine has a turbine blade body having film cooling holes, the interior space of which is partitioned into two cavities by a rib having a plate-like shape. The rib is arranged substantially perpendicular to the center line connecting between the leading edge and trailing edge in the plane substantially perpendicular to the axial line of the turbine blade body in the vertical direction. Inserts are respectively arranged in the cavities in such a way that the cooling space is formed between the exterior surface of the insert and the interior surface of the turbine blade body. The inserts each have a hollow shape and impingement holes. In addition, a communication means such as bypass holes and slit(s) is formed with the rib to provide a communication between the cavity arranged in the leading-edge side and the cavity arranged in the trailing-edge side in the turbine blade body.

In the above, the cooling air that is introduced into the inserts is forced to flow into the cooling spaces via the impingement holes. Thus, the turbine blade body is subjected to impingement cooling. Then, the cooling air spurts out from the film cooling holes, thus forming film layers around the turbine blade body. Thus, the turbine blade body is subjected to film cooling. Herein, a part of the cooling air in the cooling space arranged in the leading-edge side is guided and is forced to flow into the cooling space arranged in the trailing-edge side. Therefore, it contributes to the cooling of the cooling space arranged in the trailing-edge side. Specifically, the cooling air transmitted through the communication means formed with the rib is transmitting through and is cooling the cooling space arranged in the trailing-edge side; then, it is forced to flow out from the trailing edge of the turbine blade body while cooling pin fins.

The communication means is arranged in either the rear side or front side, which has a good heat transmission in the turbine blade body. That is, the impingement cooling is interrupted with respect to the prescribed side having a good heat transmission compared with the other side in the turbine blade body.

Further, a partition wall can be arranged between the rib and the insert arranged in the trailing-edge side, thus providing a separation between the cooling space arranged in the rear side and the cooling space arranged in the front side in the turbine blade body. That is, it is possible to prevent the cooling air transmitted through the communication means from proceeding to the cooling space of the front side (or rear side) from the cooling space of the rear side (or front side). In other words, it is possible to prevent the impingement cooling of the front side (or rear side) from being interrupted by the cooling space that is transmitted through the communication means from the rear side (or front side) in the turbine blade body.

Thus, it is possible to noticeably reduce the amount of cooling air transmitted within the turbine blade body. In addition, it is possible to reduce temperature differences entirely over the turbine blade body as small as possible. That is, it is possible to reliably improve the performance entirely over the gas turbine using the aforementioned turbine blade.

BRIEF DESCRIPTION OF THE DRAWINGS

These and other objects, aspects, and embodiments of the present invention will be described in more detail with reference to the following drawing figures, in which.

DESCRIPTION OF THE PREFERRED EMBODIMENT

Figure 4:
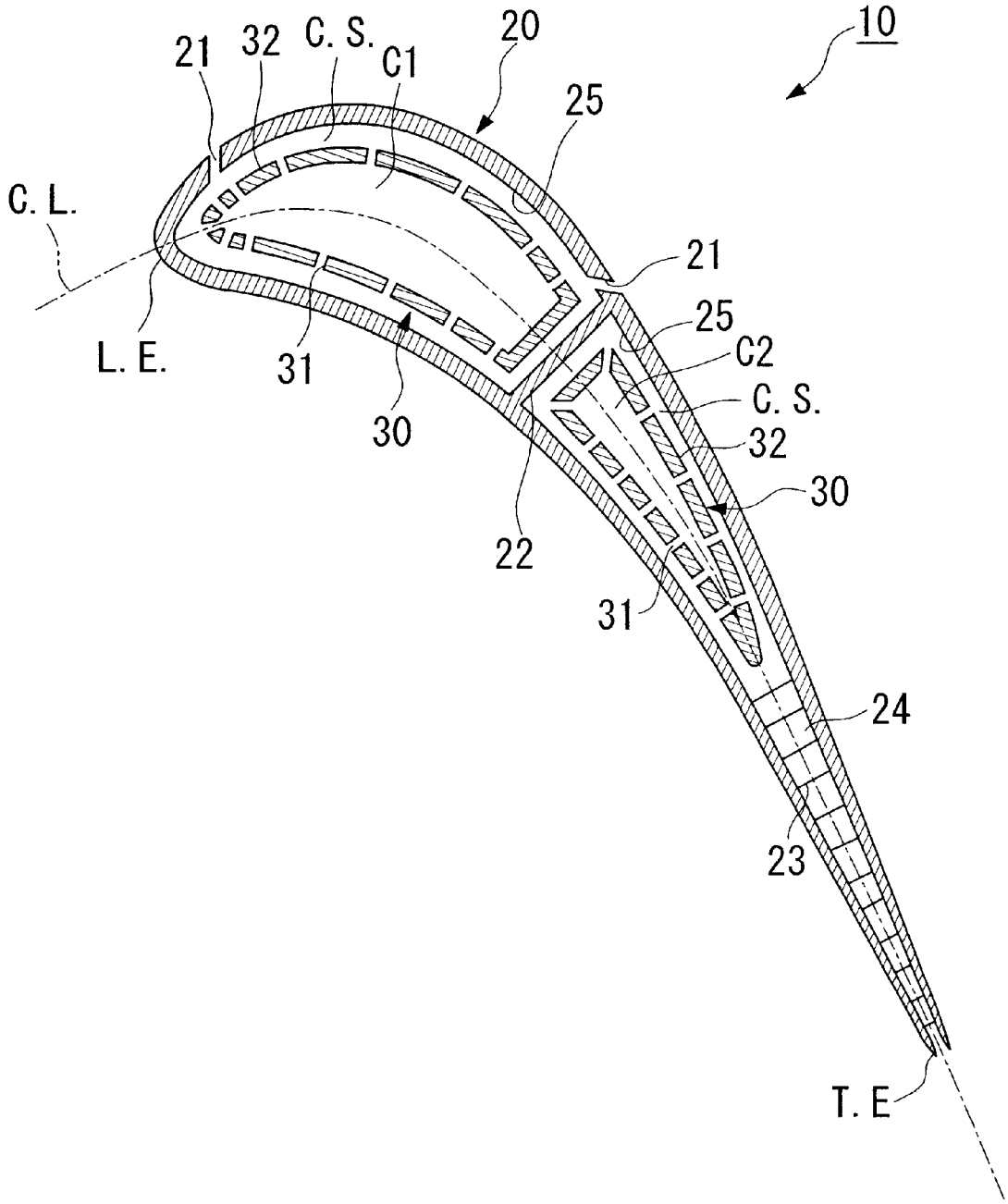
FIG. 4 is a cross sectional view of an approximately center portion of a turbine blade of a second row (row 2) equipped in a turbine along with a plane substantially perpendicular to an axial line in a vertical direction.
Figure 5:
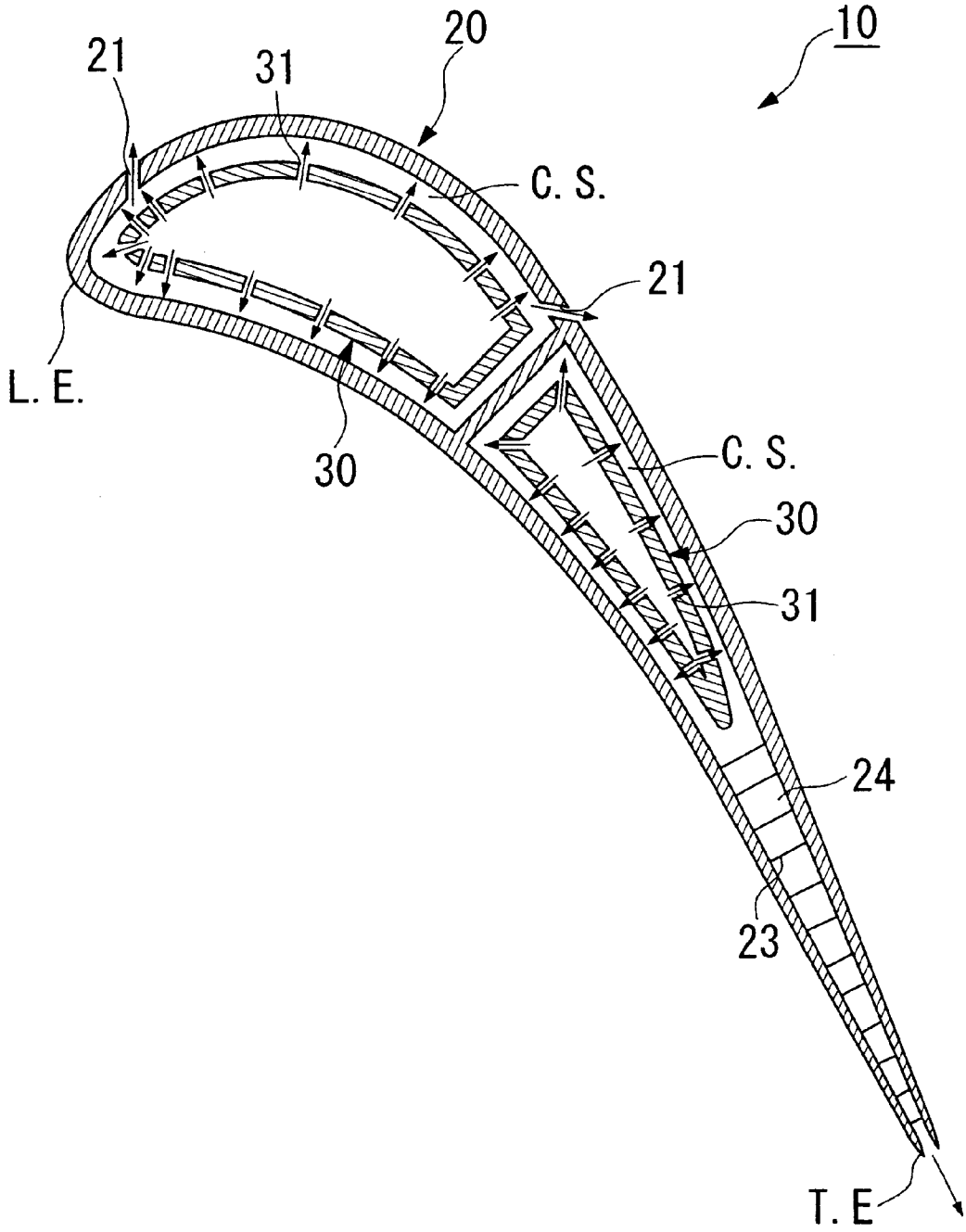
FIG. 5 is a cross sectional view of the turbine blade of FIG. 4 that is used to explain flows of cooling air.

This invention will be described in further detail by way of examples with reference to the accompanying drawings, wherein parts identical to those shown in FIGS. 4 and 5 are designated by the same reference numerals.

Figure 1:
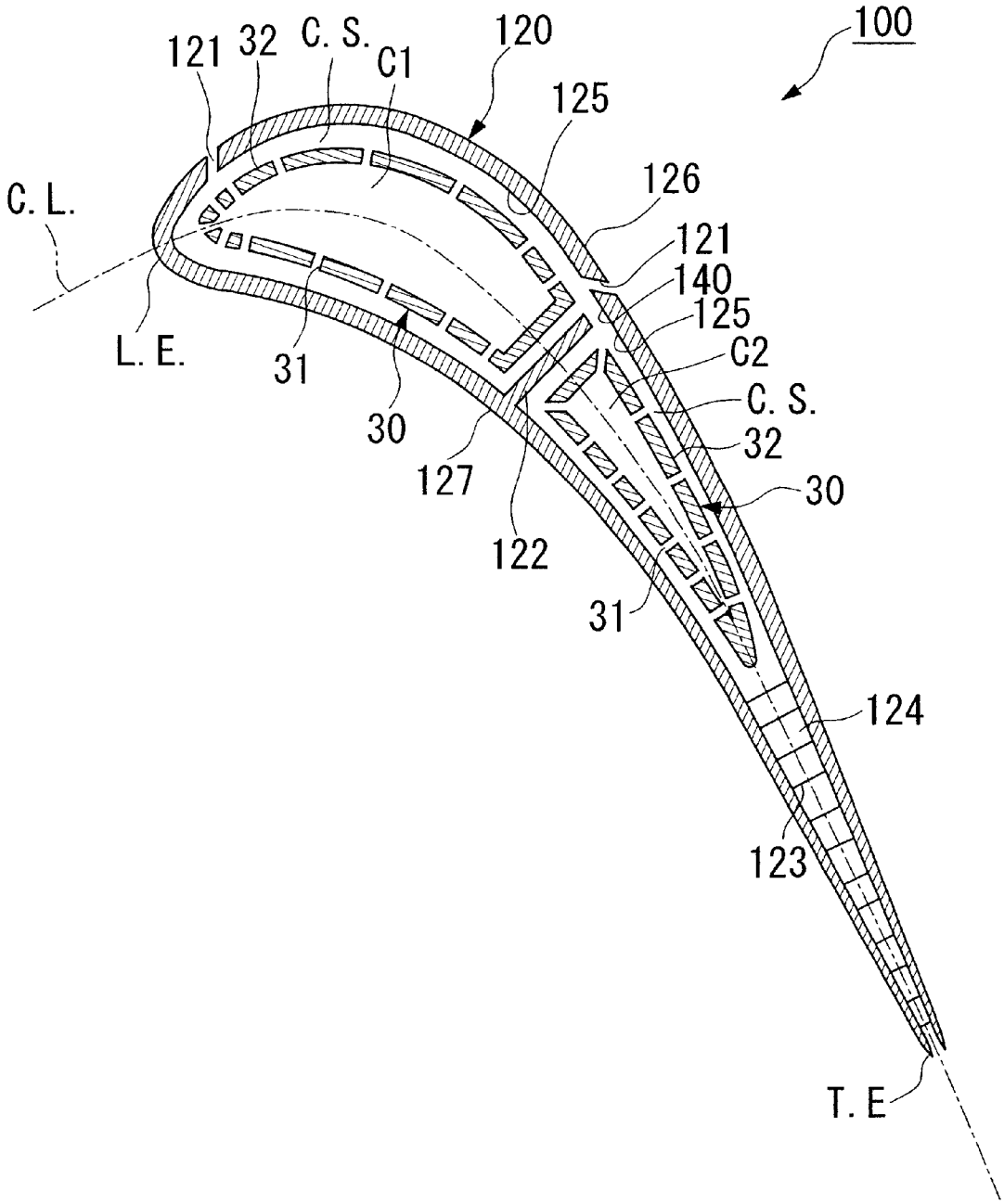
FIG. 1 is a cross sectional view of an approximately center portion of a turbine blade in a second row (row 2) equipped in a turbine along with a plane substantially perpendicular to an axial line in a vertical direction.

FIG. 1 shows a cross section showing an approximately center portion of a stationary blade of a second row (row 2) (hereinafter, referred to as a turbine blade) equipped in a turbine (not shown) along with the plane substantially perpendicular to an axial line in a vertical direction.

That is, a turbine blade 100 shown in FIG. 1 comprises a turbine blade body 120 and two inserts 30.

In the plane substantially perpendicular to an axial line of the turbine blade body 120 in the vertical direction, a leading edge 'L.E.' is connected with a trailing edge 'T.E.' by a 'curved' center line 'C.L.'. The turbine blade body 120 has film cooling holes 121 and a sheet of a plate-like rib 122 that is arranged substantially perpendicular to the center line C.L. and partitions the interior space of the turbine blade 120 into two cavities C1 and C2. Air holes 24 having pin fins 23 are arranged with respect to the cavity C2 that is arranged in the side of the trailing edge T.E., wherein they force the cooling air in the cavity C2 to flow towards the exterior of the turbine blade body 20.

In proximity to the rib 122, a communication means 140 is arranged in a rear side 126 of the turbine blade body 120 to provide a communication between the cavity C1 arranged in the side of the leading edge L.E. and the cavity C2 arranged in the side of the trailing edge T.E.

The insert 30 has a hollow shape and provides the prescribed number of impingement cooling holes 31. One insert 30 is inserted into each of the cavities C1 and C2 in such a way that a cooling space C.S. is formed between an exterior surface 32 of the insert 30 and an interior surface 125 of the turbine blade body 120.

Figure 2:
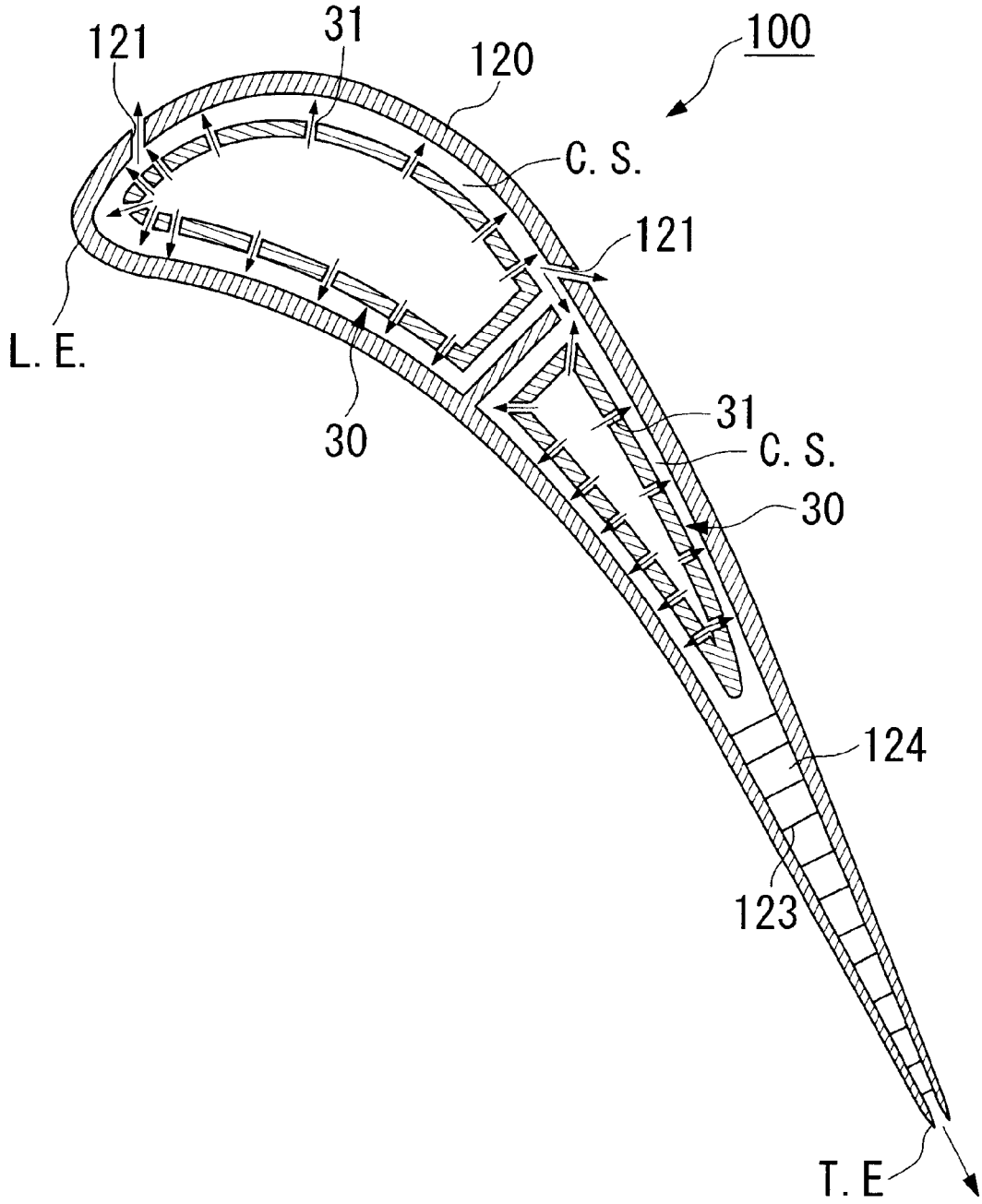
FIG. 2 is a cross sectional view of the turbine blade of FIG. 1 that is used to explain flows of cooling air.

In the turbine blade 100 having the aforementioned structure, the cooling air is introduced into the internal space of the inserts 30 by a specific means (not shown); then, the cooling air is forced to flow into the cooling spaces C.S. through the impingement holes 31 as shown by sold arrows in FIG. 2, so that the turbine blade body 120 is subjected to impingement cooling. Then, the cooling air is further forced to flow outwards through the film cooling holes 121 of the turbine blade body 120. This causes film layers formed around exterior walls of the turbine blade body 120 due to the cooling air, so that the turbine blade body 120 is subjected to film cooling. In addition, the cooling air spurts out through the air holes 124 from the trailing edge T.E. of the turbine blade body 120. Herein, the proximal portion of the trailing edge T.E. of the turbine blade body 120 are cooled down by the cooling air cooling the pin fins 123.

Further, a part of the cooling air in the cooling space C.S. arranged in the side of the leading edge L.E. is introduced into the cooling space C.S. arranged in the side of the trailing edge T.E. by way of the communication means 140. Then, it is lead to the exterior of the turbine blade body 120 through the air holes 124.

In the aforementioned structure, a part of the cooling air in the cooling space C.S. arranged in the side of the leading edge L.E. contributes to the cooling of the pin fins 123. Therefore, it is possible to reduce the amount of the cooling air that may excessively spurts out from the impingement holes 31 of the insert arranged in the side of the trailing edge T.E. in the conventional art. Thus, it is possible to improve the efficiency entirely over the gas turbine. This may prevent the prescribed portion, i.e., center portion of the turbine blade body 120 from being excessively cooled compared with other portions. Hence, it is possible to reliably reduce temperature differences entirely over the turbine blade body 120 as small as possible.

The aforementioned communication means 140 can be realized by plural bypass holes that penetrate through the rib 122 in its thickness direction and that are arranged along the axial line (perpendicular to the drawing sheet) of the turbine blade body 120 in the vertical direction.

It is possible to adequately select desired sizes, shapes, and arrangement for the bypass holes in response to the heat transmission of the turbine blade body 120.

Alternatively, the communication means 140 can be realized by at least one slit that penetrates through the rib 122 in its thickness direction and that is arranged along the axial line (perpendicular to the drawing sheet) of the turbine blade body 120 in the vertical direction.

Similar to the aforementioned bypass holes, it is possible to adequately select desired sizes, shapes, and arrangement for the slit(s) in response to the heat transmission (or conductivity) of the turbine blade body 120.

The aforementioned communication means 140 may be preferably arranged either the rear side 126 or a front side 127, which is superior in heat transmission.

By arranging the communication means in the prescribed side having a good heat transmission, it is possible to block the impingement cooling in the prescribed side having a good heat transmission. That is, it is possible to reduce temperature differences between the prescribed side having a good heat transmission and the other side.

The present embodiment is not necessarily limited in such a way that the communication means 140 is solely arranged for the turbine blade body 120 in either the rear side 126 or front side 127, which is superior in heat transmission. Instead, it is possible to arrange communication means both at the rear side 126 and front side 127 of the turbine blade body 120. Herein, it is necessary to adequately select desired sizes, shapes, and arrangement for the bypass holes or slit(s) in such a way that the impingement cooling of the other side would not be disturbed (or interrupted) compared with the prescribed side having a good heat transmission.

One solution is to provide the greater number of bypass holes or slits in the prescribed side having a good heat transmission compared with the other side.

The same effect can be realized by adequately adjusting the sizes (or diameters) of bypass holes or sizes of slits.

Because of the aforementioned structure, the impingement cooling of the prescribed side having a good heat transmission will be disturbed; therefore, it is possible to reduce temperature differences between the prescribed side having a good heat transmission and the other side.

Figure 3:
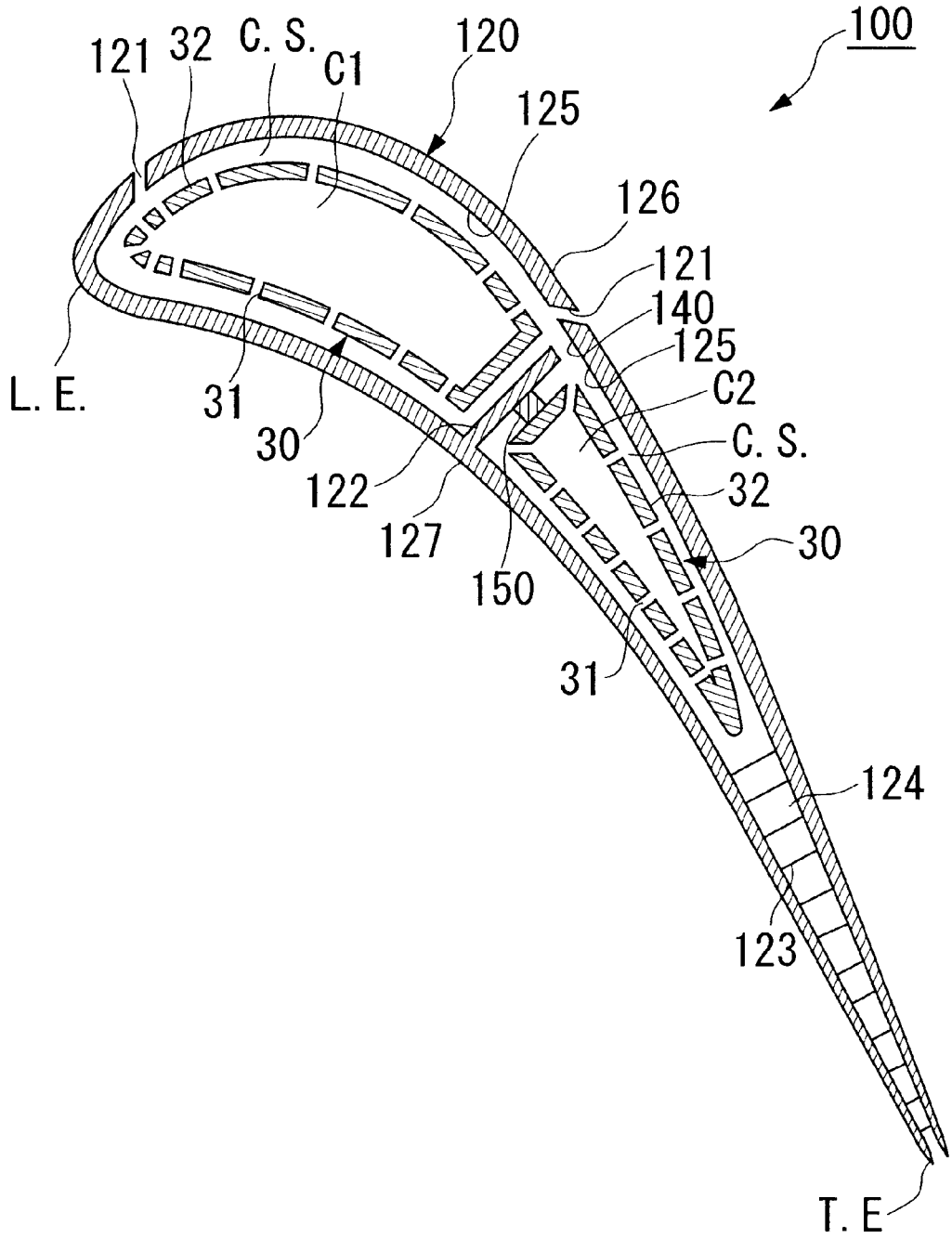
FIG. 3 is a cross sectional view showing a modified example of the turbine blade of FIG. 1 that provides a partition wall between a rib and an insert arranged in a trailing-edge side.

It is further preferable to arrange a partition wall 150 between the rib 122 and the insert 30 arranged in the side of the trailing edge T.E. as shown in FIG. 3, wherein the partition wall 150 separates the cooling space C.S. in the rear side 126 of the turbine blade body 120 and the cooling space C.S. in the front side 127 of the turbine blade body 120.

It is possible to integrally form the partition wall 150 with the rib 122 or the insert 30 arranged in the side of the trailing edge T.E. Alternatively, the partition wall 150 can be formed independently of the rib 122 or the insert 30.

Further, the partition wall 150 can be formed like a seal dam, which is conventionally known, as necessary.

In the aforementioned structure having the partition wall 150 shown in FIG. 3, the cooling air transmitted through the communication means 140 is forced to flow towards the air holes 124 through only the cooling space C.S. arranged in the rear side of the turbine blade body 120. That is, the partition wall 150 prevents the cooling air transmitted through the communication means 140 from proceeding to the cooling space C.S. arranged in the rear side 126 of the turbine blade body 120. Therefore, it is possible to prevent the impingement cooling in the cooling space C.S. arranged in the front side 127 from being interrupted due to the the cooling air transmitted through the communication means 140.

This invention is not necessarily used for the stationary blade in the second row (row 2). Therefore, it can be applied to stationary blades of other rows as well as moving blades in the gas turbine as necessary.

In addition, this invention is not necessarily applicable to the prescribed structure of the turbine blade having two cavities partitioned by one rib. Hence, this invention is applicable to other types of turbine blades having three or more cavities partitioned by two or more ribs.

Incidentally, a gas turbine comprises a turbine, a compressor for compressing combustion air, and a combustion chamber for combining the combustion air with fuel to burn, thus producing high-temperature combustion gas, wherein the turbine is designed to use the aforementioned examples of the turbine blades.

As described heretofore, this invention has a variety of technical features and effects, which will be described below.

(1) The turbine blade of this invention is designed in such a way that a part of the cooling air in the cooling space arranged in the leading-edge side of the rib is guided and is forced to flow into the cooling space arranged in the trailing-edge side of the rib. Therefore, it contributes to the cooling of the cooling space arranged in the trailing-edge side of the rib. Hence, it is possible to reduce the amount of cooling air that is used for the cooling of the cooling space arranged in the trailing-edge side of the rib.

(2) In addition, the cooling air transmitted through the communication means formed with the rib are transmitting through to cool the cooling space arranged in the trailing-edge side of the rib; then, it spurts out from the turbine blade body while cooling the pin fins arranged in the trailing edge of the turbine blade. Therefore, it is possible to reduce the amount of cooling air that is forced to flow into the cooling space arranged in the trailing-edge side of the rib. This contributes to improvements in the performance entirely over the gas turbine. Further, it is possible to reduce temperature differences entirely over the turbine blade body as small as possible.

(3) The aforementioned communication means can be realized by the prescribed number of bypass holes that are formed to penetrate through the rib in its thickness direction. It is possible to easily manufacture the turbine blade having bypass holes in the rib. In addition, it is possible to adequately and freely select desired sizes, shapes, and arrangement for the bypass holes in consideration of the heat transmission of the turbine blade body.

(4) Alternatively, the communication means can be realized by at least one slit that is formed to penetrate through the rib in its thickness direction. It is possible to easily manufacture the turbine blade having slits in the rib. In addition, it is possible to adequately and freely select desired sizes, shapes, and arrangement for the slits in consideration of the heat transmission of the turbine blade body.

(5) The turbine blade can be designed to intentionally disturb or interrupt the impingement cooling either in the rear side or the front side, which provides a good heat transmission in the turbine blade body. Therefore, it is possible to reliably reduce temperature differences between the rear side and front side of the turbine blade body. In other words, it is possible to reduce temperature differences entirely over the turbine blade body; thus, it is possible to avoid occurrence of heat stress in the turbine blade.

(6) In the above, the turbine blade may have a property that one of the rear side and front side of the turbine blade body has a good heat transmission. Herein, the impingement cooling is greatly disturbed or interrupted in the prescribed side having a good heat transmission compared with the other side in the turbine blade body. Hence, it is possible to reduce temperature differences between the rear side and front side of the turbine blade body. In other words, it is possible to reduce temperature differences entirely over the turbine blade body; thus, it is possible to avoid occurrence of heat stress in the turbine blade.

(7) The turbine blade can be further modified to provide a partition wall between the rib and the insert arranged in the trailing-edge side of the rib. Due to the provision of the partition wall, it is possible to prevent the impingement cooling in the front side from being interrupted by the cooling air that may proceed to the front side from the rear side. In addition, it is possible to prevent the impingement cooling in the rear side from being interrupted by the cooling air that may proceed to the rear side from the front side.

(8) The gas turbine having the aforementioned turbine blade is correspondingly designed in such a way that a part of the cooling air in the cooling space arranged in the leading-edge side of the rib is guided and is forced to flow into the cooling space arranged in the trailing-edge side of the rib, wherein it contributes to the cooling of the cooling space arranged in the trailing-edge side of the rib. This contributes to improvements of the performance entirely over the gas turbine because it is possible to reduce the amount of cooling air that is forced to flow into the cooling space of the trailing-edge side of the rib in the turbine blade.

(9) The gas turbine having the modified turbine blade is correspondingly designed in such a way that the cooling air transmitted through the communication means formed with the rib is transmitting through and is cooling the cooling space arranged in the trailing-edge side of the rib, and then it spurts out from the turbine blade body while cooling the pin fins arranged in the trailing edge of the turbine blade. Hence, it is possible to reduce the amount of cooling air that is forced to flow into the cooling space arranged in the trailing-edge side of the rib in the turbine blade. This contributes to improvements of the performance entirely over the gas turbine because it is possible to reduce temperature differences entirely over the turbine blade body as small as possible.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A turbine blade having a front side and a rear side and comprising:

a turbine blade body;

a plurality of film cooling holes that are arranged on exterior walls of the turbine blade body;

at least one rib having a plate-like shape that is arranged substantially perpendicular to a center line connecting between a leading edge and a trailing edge in a plane substantially perpendicular to an axial line of the turbine blade body in a vertical direction, so that an overall interior space of the turbine blade body is partitioned into at least two cavities by the at least one rib;

a plurality of inserts, each of which has a hollow shape and a plurality of impingement holes, wherein the inserts are each arranged in the cavities in such a way that a cooling space is formed between an exterior surface of the insert and an interior surface of the turbine blade body, and wherein cooling air introduced into the inserts is forced to flow into the cooling space through the impingement holes so that the turbine blade body is subjected to impingement cooling, while the cooling air spurts out through the film cooling holes of the turbine blade body to form film layers around the turbine blade body, so that the turbine blade body is subjected to film cooling; and a communication means, formed substantially adjacent to one of the rear side, the front, and both the rear and the front sides of the turbine blade body, provide a communication between the cavity arranged in a leading-edge side and the cavity arranged in a trailing-edge side.

2. A turbine blade according to claim 1, wherein the communication means comprises a plurality of bypass holes that are formed to penetrate through the rib in its thickness direction.

3. A turbine blade according to claim 2, wherein the communication means is arranged in a rear side and a front side substantially in parallel with the axial line of the turbine blade body in the vertical direction, and wherein the communication means is formed to impart a great influence to impingement cooling in either the rear side or the front side that has a good heat transmission.

4. A turbine blade according to claim 1, wherein the communication means comprises at least one slit that is formed to penetrate through the rib in its thickness direction.

5. A turbine blade according to claim 1, wherein the communication means is arranged substantially in parallel with the axial line of the turbine blade body in the vertical direction providing good heat transmission in the turbine body.

6. A turbine blade according to claim 5 further comprising a partition wall that is arranged between the rib and the insert arranged in the trailing-edge side, thus providing a separation between the cooling space in the rear side and the cooling space in the front side.

7. A gas turbine using the turbine blade according to claim 6, comprising:

a turbine having the turbine blade;

a compressor for compressing combustion air; and a combustion chamber for combining the combustion air with fuel to burn, thus producing high-temperature combustion gas.

8. A gas turbine using the turbine blade according to claim 5, comprising:

a turbine having the turbine blade;

a compressor for compressing combustion air; and a combustion chamber for combining the combustion air with fuel to burn, thus producing high-temperature combustion gas.

9. A turbine blade according to claim 1, wherein the communication means is arranged in a rear side and a front side substantially in parallel with the axial line of the turbine blade body in the vertical direction, and wherein the communication means is formed to impart a great influence to impingement cooling in either the rear side or the front side that has a good heat transmission.

10. A turbine blade according to claim 9 or 3 further comprising a partition wall that is arranged between the rib and the insert arranged in the trailing-edge side, thus providing a separation between the cooling space in the rear side and the cooling space in the front side.

11. A gas turbine using the turbine blade according to claim 9 or 3, comprising:

a turbine having the turbine blade;

a compressor for compressing combustion air; and a combustion chamber for combining the combustion air with fuel to burn, thus producing high-temperature combustion gas.

12. A gas turbine using the turbine blade according to any one of claims 1 to 4, comprising:

a turbine having the turbine blade;

a compressor for compressing combustion air; and a combustion chamber for combining the combustion air with fuel to burn, thus producing high-temperature combustion gas.

* * * * *